United States Patent [19]

Roberts et al.

[11] Patent Number: 4,633,128

[45] Date of Patent: Dec. 30, 1986

[54] SHORT ARC LAMP WITH IMPROVED THERMAL CHARACTERISTICS

[75] Inventors: Roy D. Roberts, Newark; Robert L. Miner, Palo Alto, both of Calif.

[73] Assignee: ILC Technology, Inc., Sunnyvale, Calif.

[21] Appl. No.: 735,380

[22] Filed: May 17, 1985

[51] Int. Cl.[4] ..... H01J 61/30; H01J 5/16

[52] U.S. Cl. ..... 313/113; 313/634

[58] Field of Search ..... 313/113, 570, 520–522, 313/632, 634, 18, 46

[56] References Cited

U.S. PATENT DOCUMENTS 2,974,243 3/1961 Marrison ..... 313/46

3,808,496 4/1974 McRae et al. ..... 313/113

*Primary Examiner*—Palmer C. DeMeo

*Assistant Examiner*—Sandra L. O'Shea

*Attorney, Agent, or Firm*—Thomas E. Schatzel

[57] ABSTRACT

A short arc type lamp having a concave reflecting wall including a convex space formed behind the concave wall such that the reflecting wall is relatively thin near the focal point of the lamp and relatively thicker radially outward. A copper sleeve member is attached to the reflecting wall within the convex space to conduct heat from the reflecting wall to the exterior wall of the lamp.

8 Claims, 3 Drawing Figures

SHORT ARC LAMP WITH IMPROVED THERMAL CHARACTERISTICS

BACKGROUND OF THE INVENTION

1. Field of the Invention

The present invention relates generally to arc lamps, and more particularly, arc lamps of the type which have short arc gaps.

2. Description of the Prior Art

It is well-known to utilize lamps having short arc gaps to provide intense point sources of light for applications such as instrumentation and projection. More specifically, it is well known to utilize short arc lamps in medical endoscopes, which serve as illuminators of fiber optic bundles that allow visual examination of body canals and adjacent organs without conventional surgery. Short arc lamps are also used in industrial endoscopes to examine structures and components difficult to inspect visually, such as the interiors jet engines. Generally speaking, such lamps include a sealed concave chamber which contains a gas pressurized to several atmospheres, an anode and cathode which are mounted along the central axis of the concave chamber to define an arc gap, and a window at the mouth of the chamber to permit transmission of light generated by electrical discharge across the arc gap. It is known that the lamp body can be formed of an opaque cylinder of ceramic material and that the concave chamber can be formed in one end of the cylinder by a mandrel or the like.

In such prior arc lamps, the temperatures generated within the lamps may be quite high, sometimes exceeding 600° C. Because the temperatures at the exterior of the lamp are substantially lower, large temperature gradients exist through the lamp body. One result of such temperature gradients in prior art lamps has been cracking of the ceramic body or of the reflector surface especially if the lamps are used at high wattages, say above 800 watts. Such cracking can cause discontinuities or discolorations in the reflective surface of the lamp, thereby diminishing the effectiveness of the lamp as an illuminator. In addition, such cracking can lead to potentially explosive conditions.

SUMMARY OF THE INVENTION

A primary object of the present invention is to provide an improved lamp of the short arc type having a ceramic body which is less susceptible to cracking due to temperature gradients.

A related object of the present invention is to provide an improved lamp of the short arc type having a ceramic body which has reduced susceptibility to cracking under thermal stresses and, hence, can be operated at increased wattages.

In accordance with the preceding objects, the present invention provides an improved lamp of the short arc type comprising: a body formed of an opaque dielectric material having a concave cavity formed therein defining a curved reflecting wall symmetrical about a central axis of the lamp; a transparent window assembly sealingly mounted across the mouth of the concave cavity such that pressurized gas is maintained in said cavity; a pair of electrodes mounted within said cavity to extend along the central axis with the distal ends of the electrodes being spaced apart a distance which defines a short arc gap at the focal point of said curved reflecting wall; a base plate sealingly secured to the body at the end opposite the mouth of said concave cavity; and a convex space within the body behind said reflecting wall such that said reflecting wall is relatively thin near the focal point of said concave cavity and relatively thicker radially outward from the central axis.

In accordance with the preceding, an advantage of the present invention is the provision of an improved lamp of the short arc type having a ceramic body which is less susceptible to cracking due to temperature gradients and, hence, which can be operated at increased power levels.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
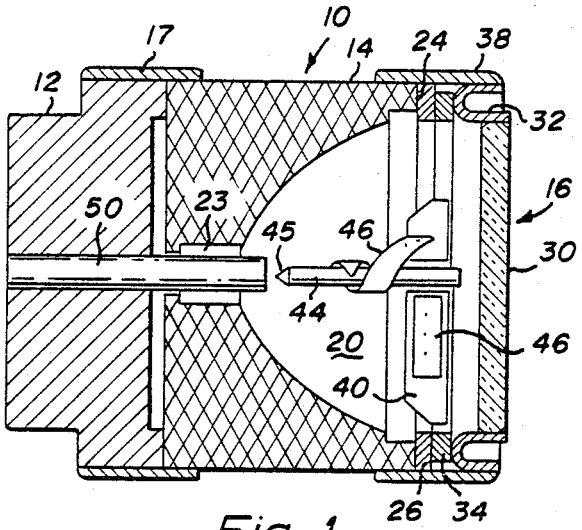
FIG. 1 is a side view, in axial section, of a lamp according to the prior art.

FIG. 1 illustrates a high intensity lamp, generally designated by the reference character 10, of the type known in the prior art as a short arc lamp. The lamp 10 includes a metallic base 12, a body section 14, and a window assembly generally designated by the reference character 16. The base, the body, and the window assembly are all generally circular in transverse cross-section, and are generally symmetrical about a longitudinal central axis "A". The base 12 is secured to the body 14 by a cylindrical metallic band 17 which overlappingly surrounds both the body and the base. In practice, the base 12 is formed of iron, which material is chosen for its purity as well as electrical and thermal conductivity characteristics. The base 12 functions both as a heat sink for the lamp and as an electrical conductor to carry current to the electrodes in the lamp.

In practice, the body 14 is preferrably formed of a ceramic alumina material. Also, in practice, the body 14 is metallized to simplify attachment of metallic components thereto, for example, by brazing. Such metallization may comprise a mixture of molybdenum and manganese which is fixed onto the ceramic material of the body 14 by firing.

The body 14 of the prior art lamp of FIG. 1 includes a concave cavity 20 defining a curved reflecting surface 22 which is symmetrical about the central axis "A". In practice, the curved reflecting surface 22 may be parabolic, elliptical or aspherical to provide a highly collimated output beam. The reflecting surface 22 typically has a reflective metal coating deposited thereon. A circular rim 24 defines the mouth of the concave cavity 20. A ceramic spacer ring 26 is secured about the rim 24. It should be noted that the body 14 of the lamp of FIG. 1 is essentially solid except for cylindrical recess 23 formed at the apex of the concave chamber 20.

The window assembly 16 of the lamp 10 of FIG. 1 fits sealingly against the spacer ring 26 so that the cavity 20 is gas-tight. The window assembly 16 includes a transparent circular window 30 formed, for example, as a sapphire disk. The outer periphery of the window 30 is surrounded by a circular flange 32 is U-shaped which has an inside diameter such that the window 30 snugly fits therein. A metallic spacer ring 34 is interposed between the flange 32 and the ceramic spacer ring 26. A cylindrical metal band 38 overlappingly surrounds the window assembly 16 and the body 14 to secure the window assembly to the body. The band 38 also serves to conduct current from the cathode 44 via the metallic spacer ring 34 and the support struts 40.

The window assembly 16 of the prior art lamp 10 of FIG. 1 further includes radially-extending support struts 40 secured to the spacer ring 34 at their radially outward ends and positioned to extend radially inward across the face of the window 30. In practice, the struts 40 are formed of molybdenum and are secured, as by brazing, to the spacer ring 34. The three struts 40 support a rod-shaped refractory cathode 44 formed, for example, of tungsten. The cathode member 44 is circular in cross-section and has an end portion 44 which tapers to a tip 45 adjacent the focal point of the cavity 20.

Strips of metal, called "getters", 46 are secured to the window assembly 16 via the struts 40 and the cathode 44. The getters 46 are typically fabricated of zirconium and are required to absorb impurities formed within the cavity 28 during operation of the lamp 10. Such impurities may be generated, for example, by outgassing of impurities from the lamp components during operation.

The prior art lamp 10 of FIG. 1 further includes a rod-like anode member 50 which extends along the central axis of the lamp from the base 12 to a location adjacent the focal point of the concave cavity 20. The end of the anode member adjacent the tip 45 of the cathode 44 is planar in a directon normal to the central axis of the lamp. At the apex end of the concave cavity 20, the cylindrical recess 23 defines an annular space concentrically surrounding the distal end of the anode member 50. The distance between the distal end of the anode member 50 and the tip 45 of the cathode member 44 defines the arc gap. This distance is typically greater than about 0.025 inches and less than about 0.075 inches.

In operation of the lamp of FIG. 1, the cavity 20 is filled with an inert gas, such as xenon, at a pressure of several atmospheres. The lamp is illuminated when the so-called breakdown voltage is exceeded across the arc gap, thereby resulting in an illuminating flow of electrons (i.e., arc discharge) across the gap from the cathode 44 to the anode 50. Typically, such lamps operate from about one hundred fifty to five hundred watts.

Figure 2:
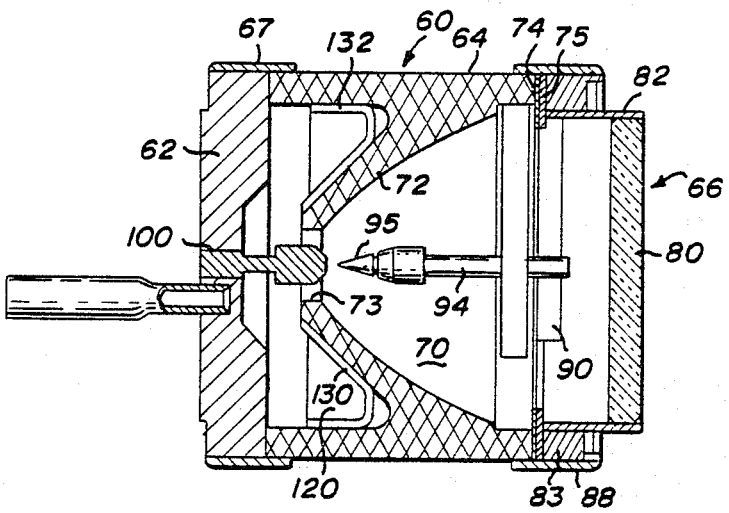
FIG. 2 is a side view, in axial section, of a lamp according to the present invention.
Figure 3:
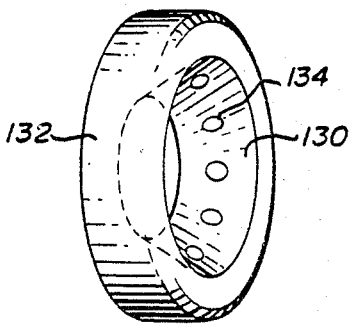
FIG. 3 is a pictorial view of a component of the lamp of FIG. 2.

FIGS. 2 and 3 show an arc lamp 60 according to the present invention. The lamp 60 generally includes a base plate member 62, a body 64 having a generally cylindrical exterior configuration, and a window assembly generally designated by the reference character 66. The base plate 62 is sealingly secured to the body 64 by a cylindrical metallic band 67. As in the prior art lamp, the base 62 formed of relatively pure iron, and the body is preferably formed of an opaque dielectric ceramic alumina material which is metallized.

In the lamp of FIG. 2, the ceramic body 64 includes a concave cavity 70 defining a curved reflecting wall 72 which is symmetrical about the central axis of the lamp. The reflecting surface 72 typically has a reflective coating deposited thereon and can be parabolic, eliptical or aspherical. A circular opening 73 is formed centrally through the reflecting wall 72 at the apex end of the cavity 70 opposite its mouth. The body 64 further includes a circular rim portion 74 which defines the mouth of the concave cavity 70. A ceramic spacer ring 75 can be provided to surround the rim portion 74.

The window assembly 66 of the lamp of FIG. 2 includes a transparent circular window 80 and a metallic cylindrical cowl member 82 which has an inside diameter such that the circular window 80 sealingly fits therein. A metallic spacer ring 83 surrounds the cowl member 82 and has an outside diameter approximately equal to the outside diameter of the body 64. A cylindrical metal band 88 surrounds the window assembly 66 and overlaps the spacer ring 83 and the end of the body 64 to hold the window assembly 66 sealing in place about the mouth of the concave cavity 70.

The window assembly 66 of the lamp of FIG. 2 further includes radially extending strut members 90 secured to the cylindrical cowl at their radially outward ends and positioned to extend inwardly to support a cathode member 94 which extends along the central axis of the lamp to a location adjacent the focal point of the concave cavity 70. The cathode member is an elongated member generally circular in cross section, having an end portion which tapers to a tip 95 adjacent the focal point of the cavity 70.

The lamp 60 of FIG. 2 further includes an anode member 100 which extends along the central axis of the lamp to a location adjacent the focal point of the concave cavity 70. At its other end, the anode member is secured to the base plate 62.

By way of contrast to the lamp of FIG. 1, the lamp 60 of the present invention includes a convex space 120 which is formed within the body 64 behind the reflecting wall 72. More particularly, the convex space 120 is symmetrical about the central axis of the lamp and formed to have a shape such that the reflecting wall 72 is relatively thin near the focal point of the cavity 70 and relatively thicker radially outward from a central axis of the lamp and the section of the body wall adjacent the base plate is cylindrical in interior configuration. It should be noted that the concave cavity 70 is in gas-flow communication with the convex space 120 via the circular opening 73 through the reflecting wall 72.

Referring now to FIGS. 2 and 3, the lamp 64 of the present invention further includes a metallic sleeve member 130 which is mounted within the convex space 120 to lie flat against the back surface of the reflecting wall 72. As shown in FIG. 3, the sleeve 130 has a generally frusto-conical shape and, at its larger end, a cylindrical flange portion 132 which extends back from the larger end of the sleeve towards the smaller end. Holes 134 are formed through the sleeve 130 to permit outgassing from the ceramic material forming the reflecting wall 72. Perferably, the sleeve is formed from copper, because of its high heat transfer coefficient. Such a copper sleeve can be readily attached to the ceramic of the lamp body by brazing.

The advantages of a lamp body constructed according to the preceding teachings can now be readily appreciated. In operation of a short arc lamp, extremely high temperatures are generated near the arc gap and the surface of the concave reflecting wall adjacent the arc gap can be at temperatures of about 600° C. Because the exterior of the lamp body are exposed to much lower temperatures in its operating environment, substantial temperature gradients exist between the focal point of the lamp and the exterior of the body. Such temperature gradients have been calculated to produce, for example, tension stresses of about 8000 psi at the surface of the reflector wall; it is such stresses that cause cracking of the reflector wall surface. In the lamp of the present invention, having a reflecting wall 72 which is relatively thin near the focal point of the cavity 70, the temperature gradients, and hence, thermal stresses on the reflecting wall are substantially reduced; this is because the concave and convex sides of the wall are closer in temperature than when a thick wall exists. In addition, the flow of heat energy from the reflecting wall is enhanced by convection and radiation through the convex space 120. Further, the sleeve 130 assists in permitting heat energy to flow from the reflecting wall by means of conductive heat transfer. In essence, the sleeve 130, because of its high conductive heat transfer coefficient, increases the rate at which thermal energy is dissipated from the reflecting wall adjacent the arc gap. The flange portion 132 provides a conductive path for the heat to reach the exterior wall of the lamp.

In practice, it has been found that the reduced temperatures at the surface of the reflecting wall also substantially increase the reflecting efficiency of the wall. The increase in reflecting efficiency can, under certain conditions, approach 50%. Also, because the lamp of the present invention is less susceptible to cracking due to thermal gradients, the lamps can be reliably operated at increased power levels. For example, lamps according to the present invention have been operated at 800 to 1000 watts without cracking, whereas lamps not employing the present invention could not be operated above 500 watts without substantial likelihood of cracks appearing in the ceramic reflecting wall.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. An improved lamp of the short arc type comprising:

a generally cylindrical body formed of an opaque dielectic ceramic material having a concave cavity formed therein defining a curved, reflecting wall symmetical about a central axis of the lamp;

a transparent window assemby sealing mounted across the mouth of said concave cavity such that pressurized gas is maintained in said cavity;

a pair of electrodes mounted within said cavity to extend along said central axis with the distal ends of said electrodes being spaced apart a distance to define a short arc gap at the focal point of said curved reflecting wall;

a base plate sealingly secured to the cylindrical body at the end opposite said mouth of said concave cavity; and a convex space formed within the ceramic body behind said reflecting wall symmetrically about said central axis, the reflecting wall portion of the ceramic body separated from an outer cylindrical wall of the ceramic body by the convex space and the reflecting wall and the outer cylindrical wall joined at the opening of said concave cavity, the distance between the reflecting wall and the outer cylindrical wall is greater at the rear of said concave cavity and less toward the front of said concave cavity, said space having a shape such that said reflecting wall is relatively thin near the focal point of said concave cavity and relatively thicker radially outward from said central axis.

2. A short-arc lamp according to claim 1 further including a circular opening formed through said reflecting wall at the end of said concave cavity opposite the window assembly, said concave cavity being in gas-flow communication with the convex space via said circular opening.

3. A short arc lamp according to claim 2 further including a conductive sleeve member having generally hollow frusto-conical shape fitted flush against the back surface of said reflecting wall within said convex space.

4. An improved lamp of the short arc type comprising:

a generally cylindrical body formed of an opague dielectric material having a concave cavity formed therein defining a curved reflecting wall symmetrical about a central axis of the lamp;

a transpoarent window assemby sealingly mounted across the mouth of said concave cavity such that pressurized gas is maintained in said cavity;

a pair of electrodes mounted within said cavity to extend along said central axis with the distal ends of said electrodes being spaced apart a distance to define a short arc gap at the focal point of said curved reflecting wall;

a base plate sealingly secured to the cylindrical body at the end opposite said mouth of said concave cavity;

a convex space formed within the body behind said reflecting wall symmetrically about said central axis, said space having a shape such that said reflecting wall is relatively thin near the focal point of said concave cavity and relatively thicker radially outward from said central axis;

a circular opening formed through said reflecting wall at the end of said concave cavity opposite the window assembly, said concave cavity being in gas-flow communication with the convex space via said circular opening; and a sleeve member having a generally hollow frusto-conical shape fitted flush against the back of said reflecting wall within said convex space, and having, at its larger end, an integral cylindrical flange portion which extends from said larger end towards said smaller end.

5. A short arc lamp according to claim 4 wherein said sleeve member is formed of copper.

6. The short arc lamp of claim 5 wherein said sleeve member is attached to the ceramic body by brazing.

7. The short arc lamp of claim 4 wherein the claim 4 wherein the interior wall of the body adjacent the base plate is cylindrical in configuration, and said cylindrical flange portion is configured to fit flush against said cylindrical wall section.

8. The short arc lamp of claim 7 wherein said frusto-conical portion of said sleeve member and said cylindrical flange portion of said sleeve member are both brazed to the ceramic of the body of the lamp.

* * * * *